US006638412B2

(12) United States Patent
De Nora et al.

(10) Patent No.: US 6,638,412 B2
(45) Date of Patent: Oct. 28, 2003

(54) PREVENTION OF DISSOLUTION OF METAL-BASED ALUMINIUM PRODUCTION ANODES

(75) Inventors: Vittorio De Nora, Nassau (BS); Jean-Jacques Duruz, Geneva (CH)

(73) Assignee: Moltech Invent S.A., Luxembourg ( * ) Notice: Subject to any disclaimer, the term of this patent is extended or adjusted under 35 U.S.C. 154(b) by 0 days.

(21) Appl. No.: 10/112,673

(22) Filed: Mar. 30, 2002

(65) Prior Publication Data

US 2003/0075454 A1 Apr. 24, 2003

Related U.S. Application Data

(63) Continuation-in-part of application No. 09/897,701, filed on Jun. 29, 2001, now Pat. No. 6,540,887, which is a continuation-in-part of application No. 09/882,128, filed on Jun. 15, 2001, now abandoned, and a continuation-in-part of application No. 09/728,581, filed on Dec. 1, 2000, now Pat. No. 6,436,274.

(51) Int. Cl.[7] ..... C25C 3/08

(52) U.S. Cl. ..... 205/385; 205/380; 205/384; 205/386; 205/387; 205/379; 205/372; 204/243.1; 204/247.3; 204/247.4

(58) Field of Search ..... 204/243.1, 247.3, 204/247.4; 205/372, 379, 380, 384, 385, 386, 387

(56) References Cited

U.S. PATENT DOCUMENTS 5,651,874 A * 7/1997 de Nora et al. ..... 205/372
5,658,447 A * 8/1997 Watson et al. ..... 204/243.1
5,679,224 A * 10/1997 Sekhar ..... 204/243.1
6,077,415 A * 6/2000 Duruz et al. ..... 204/243.1

* cited by examiner

*Primary Examiner*—Bruce F. Bell
(74) *Attorney, Agent, or Firm*—Jayadeep R. Deshmukh

(57) ABSTRACT

A method of inhibiting dissolution of a transition metal alloy anode (40) of an aluminium electrowinning cell comprises providing a sodium-inert layer (11,20,50,50') on a sodium-active cathodic cell material (15), such as carbon, and electrolysing alumina dissolved in a sodium ion-containing molten electrolyte (30). Aluminium ions rather than sodium ions are cathodically reduced on the sodium-inert layer to inhibit the presence in the molten electrolyte (30) of soluble cathodically-produced sodium metal that constitutes an agent for chemically reducing the anode's transition metal oxides and anodically evolved oxygen, thereby inhibiting reduction of the anode's transition metal oxides by sodium metal and maintaining the evolved oxygen at the anode at a concentration such as to produce at the alloy/oxide layer interface stable and coherent transition metal oxides having a high level of oxidation. The sodium-inert layer may comprise molten aluminium (20) and/or a layer of refractory hard material (11,50,50').

31 Claims, 6 Drawing Sheets

PREVENTION OF DISSOLUTION OF METAL-BASED ALUMINIUM PRODUCTION ANODES

This application is a CIP of U.S. Ser. No. 09/897,701 filed Jun. 29, 2001, now U.S. Pat. No. 6,540,887; it is also a CIP of U.S. Ser. No. 09/728,581 filed Dec. 1, 2000, now U.S. Pat. No. 6,436,274 which is a CIP of U.S. Ser. No. 09/882,128 filed Jun. 15, 2001, now abandoned.

FIELD OF THE INVENTION

This invention relates to inhibiting dissolution of an oxygen-evolving anode of a cell for the production of aluminium from alumina dissolved in an sodium ion-containing molten electrolyte.

BACKGROUND ART

The technology for the production of aluminium by the electrolysis of alumina, dissolved in molten cryolite, at temperatures around 950° C. is more than one hundred years old. This process, conceived almost simultaneously by Hall and Héroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the cost of aluminium production.

U.S. Pat. No. 4,614,569 (Duruz/Derivaz/Debely/Adorian), U.S. Pat. No. 4,680,094 (Duruz), U.S. Pat. No. 4,683,037 (Duruz) and U.S. Pat. No. 4,966,674 (Bannochie/Sherriff) describe non-carbon anodes for aluminium electrowinning coated with a protective coating of cerium oxyfluoride, formed in-situ in the cell or pre-applied, this coating being maintained by the addition of a cerium compound to the molten cryolite electrolyte. This made it possible to have a protection of the surface from the electrolyte attack.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer. Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective oxygen barrier layer. However, full protection of the alloy substrate was difficult to achieve.

WO00/06802 (Duruz/de Nora/Crottaz) discloses a method of keeping an anode with a transition metal oxide layer dimensionally stable during operation in an aluminium electrowinning cell by maintaining in the electrolyte a sufficient concentration of transition metal species and dissolved alumina.

U.S. Pat. No. 6,248,227 (de Nora/Duruz) discloses an aluminium electrowinning anode having a metallic anode body which can be made of various alloys. During use, the surface of the anode body is oxidised by anodically evolved oxygen to form an integral electrochemically active oxide-based surface layer, the oxidation rate of the anode body being equal to the rate of dissolution of the surface layer into the electrolyte. This oxidation rate is controlled by the thickness and permeability of the surface layer which limits the diffusion of anodically evolved oxygen therethrough to the anode body.

WO00/06803 (Duruz/de Nora/Crottaz), WO00/06804 (Crottaz/Duruz), WO01/42534 (de Nora/Duruz), WO01/42536 (Duruz/Nguyen/de Nora) disclose further developments of metal-based aluminium production anodes.

Metal or metal-based anodes are highly desirable in aluminium electrowinning cells instead of carbon-based anodes. Many attempts were made to use metallic anodes for aluminium production, however they were never adopted by the aluminium industry for commercial aluminium production because their lifetime is limited.

SUMMARY OF THE INVENTION

An object of the invention is to provide a method of increasing the lifetime of transition metal-containing alloy anodes during operation in an aluminium electrowinning cell, in particular anodes made of a homogeneous metal alloy, such as a cast alloy or possibly an electroformed alloy.

The invention relates to a method of inhibiting dissolution of an oxygen-evolving anode of a cell for the production of aluminium from alumina dissolved in an sodium ion-containing molten electrolyte comprising a cathodic material that is predominately active for the reduction of sodium ions rather than aluminium ions. The oxygen-evolving anode comprises a transition metal-containing alloy having an integral oxide layer containing predominantly one or more transition metal oxides which slowly dissolve in the electrolyte and are compensated by oxidation of the alloy at the alloy/oxide layer interface.

According to the invention, the method comprises providing a sodium-inert layer on the sodium-active cathodic material and electrolysing the dissolved alumina whereby oxygen is anodically evolved and aluminium ions rather than sodium ions are cathodically reduced on the sodium-inert layer to inhibit the presence in the molten electrolyte of soluble cathodically-produced sodium metal that constitutes an agent for chemically reducing the transition metal oxides and evolved oxygen, in particular molecular oxygen. The sodium-inert layer is used as a dissolution inhibitor of the anode by its effect in inhibiting reduction of the transition metal oxides by sodium metal and in maintaining the evolved oxygen at the anode at a concentration such as to produce at the alloy/oxide layer interface stable and coherent transition metal oxides having a high level of oxidation.

The present invention is based on two different observations about the operation of a cell utilising transition metal-alloy anodes.

The first observation relates to the quality of the anode's integral oxide layer which slowly dissolves in the electrolyte and is compensated by oxidation of the alloy at the alloy/oxide layer interface.

A high concentration of oxygen, in particular molecular oxygen, at the anode surface permits the formation of transition metal oxides having a high level of oxidation. It has been observed that such metal oxides have a greater stability in the electrolyte and thus a lower dissolution rate than metal oxides of lower oxidation level. In addition, metal oxides having a high level of oxidation have a greater coherence and form integral anode oxide layers with a greater imperviousness to electrolyte and oxygen diffusion which also reduces the oxidation rate of the alloy and inhibits corrosion.

Thus a high concentration of oxygen, in particular molecular oxygen, at the surface of a transition metal-alloy anode with an integral oxide layer surprisingly maintains the anode whereas a low concentration of oxygen leads to faster oxidation and corrosion of the anode.

The second observation relates to the wear-rate of a transition metal alloy-based anode operated in an aluminium production cell which has surprisingly been found to be significantly higher when the cell is operated with a cathodically polarised carbon material which is directly exposed to the molten electrolyte than when the carbon material is shielded from the electrolyte by a sodium-inert layer, such as molten aluminium, a boride coating or a fused alumina layer.

As opposed to sodium-inert materials, a sodium-active material leads to the reduction of sodium ions rather than aluminium ions. Usually such sodium-active materials, e.g. carbon, chemically combine with sodium during cathodic reduction which lowers the required sodium reduction energy in comparison to the energy of sodium reduction on an inert or neutral surface, such as molten aluminium, to an extent that sodium ions rather than aluminium ions are cathodically reduced.

Furthermore, sodium metal produced by cathodic reduction of sodium ions is very soluble in the molten electrolyte and thus can easily migrate to the anode.

It follows that sodium metal near the anode will chemically reduce the oxygen evolved on the anode leading to depletion of oxygen at the anode. As mentioned above, a lower concentration of oxygen at the anode leads to faster oxidation and corrosion of the anode.

Furthermore, sodium metal dissolved in the electrolyte at the anode may chemically reduce oxides of the anode's surface which causes corrosion of the anode or the sodium metal may be oxidised by the anodic current which reduces the cell's current efficiency. Therefore, the sodium-inert layer also inhibits reduction of the anode's transition metal oxides by sodium metal and increases the current efficiency.

Thus, hiding or shielding cathodically polarised sodium-active material, e.g. carbon, from the electrolyte surprisingly reduces the wear rate of transition metal alloy anodes in the electrolyte.

Sodium-Inert Materials

The inhibition of dissolution of the alloy anodes can be achieved by shielding the sodium-active cathodic material from the electrolyte using various materials all chemically inert to sodium. Such shielding materials include molten aluminium and refractory hard material-based layers, in particular layers disclosed in WO01/42168 (de Nora/Duruz) and WO01/42531 (Nguyen/Duruz/de Nora). Examples of aluminium production cells with such coatings have been disclosed in U.S. Pat. No. 5,683,559 (de Nora), U.S. Pat. No. 6,258,246 (Duruz/de Nora), WO98/53120 (Berclaz/de Nora), WO99/02764, WO99/41429 (both de Nora/Duruz), WO00/63463 (de Nora), WO01/31086 (de Nora/Duruz) and WO01/31088 (de Nora).

These references all disclose applying a protective coating of a refractory material such as titanium diboride to a carbon component of an aluminium electrowinning cell, by applying thereto a slurry of particulate refractory material and/or precursors thereof in a colloid and/or inorganic polymer. Coatings with preformed refractory material have shown outstanding performance compared to previous attempts to apply refractory coatings to cathodes of aluminium electrowinning cells. These aluminium-wettable refractory boride coated bodies can be used in conventional cells with a deep aluminium pool and also permit the elimination of the thick aluminium pool required to partially protect the carbon cathode, enabling the cell to operate with a drained cathode.

The following attributes of these refractory boride coatings have been disclosed: excellent wettability by molten aluminium, inertness to attack by molten aluminium and cryolite, low cost, environmentally safe, ability to absorb thermal and mechanical shocks, durability in the environment of an aluminium production cell, and ease of production and processing. The boride coating also acts as a barrier to sodium penetration into the cathode, which is particularly detrimental when the cathode is made of carbon material.

However, such protective coatings and other sodium-inert cathodic materials, in particular molten aluminium and aluminium-wettable components placed on a cathodic bottom as for instance disclosed in U.S. Pat. No. 4,824,531 (Duruz/Derivaz) and U.S. Pat. No. 4,650,552 (de Nora/Gauger/Fresnel/Adorian/Duruz), have never been disclosed for their ability to inhibit dissolution of anodes having a transition metal-containing alloy with an integral oxide layer.

In fact, the effect produced at the anode by shielding from the electrolyte a cathode made of carbon or another sodium-active material has never been examined and thus never led to any technical measure and commercial utilisation.

The layer of sodium-inert material covering the sodium-active cathodic material may be electrically conductive over its entire surface or over only part thereof. For example, a conductive cell trough can be covered with a sodium-inert layer that is electrically conductive as described above where it faces the anodes and electrically non-conductive, e.g. fused alumina, where no aluminium is produced, e.g. on the sidewalls of the conductive cell trough.

The sodium-active cathodic material may comprise carbon in the form of petroleum coke, metallurgical coke, anthracite, graphite, amorphous carbon, fullerene, low density carbon or mixtures thereof.

The sodium-inert material, in particular in the form of a powder-sintered or slurry-applied or plasma-sprayed coating or possibly tiles or other preformed components, may comprises one or more refractory hard materials, for example as disclosed in the above references, in particular borides, such as borides of titanium, chromium, vanadium, zirconium, hafnium, niobium, tantalum, molybdenum, cerium, nickel and iron. The sodium-inert material, when produced from a slurry, may comprises consolidated boride particles, in particular in a dried inorganic polymeric and/or colloidal binder, for example alumina, silica, yttria, ceria, thoria, zirconia, magnesia, lithia, monoaluminium phosphate or cerium acetate or combinations thereof, all in the form of colloids and/or inorganic polymers. Furthermore, the sodium-inert material may comprise a conductive element or compound, in particular a metal such as Cu, Al, Fe or Ni for enhancing the electrical conductivity of the layer and its adherence to the cathode.

Advantageously, the sodium-inert material comprises an aluminium-wetting agent selected from at least one metal oxide and/or at least one partly oxidised metal, such as iron, copper, cobalt, nickel, zinc and manganese in the form of oxides and partly oxidised metals and combinations thereof. Such metal oxide and/or partly oxidised metal particles are reactable with molten aluminium when exposed thereto to form an alumina matrix containing metal of these particles and aluminium. Further details of such a material are disclosed in the abovementioned WO01/42168 (de Nora/Duruz). Such wetting-agents are particularly suited for use in combination with aluminium-resistant refractory compound, in particular selected from borides, silicides, nitrides, carbides, phosphides, oxides and aluminides, such as alumina, silicon nitride, silicon carbide or boron nitride or combinations thereof.

The aluminium-resistant refractory compound can be in the form of a coating, a reticulated structure or another preformed component, such as a tile, placed against the sodium-active material.

Anode Materials

The alloy of the oxygen-evolving anode can comprise at least one transition metal selected from Ti, V, Cr, Mn, Fe, Co, Ni, Cu, Nb, Mo, Ru, Rh, Pd, Ir, Pt, Au, Ce and Yb and combinations thereof. For example, the alloy contains at least one of iron, nickel and cobalt, in particular iron alloys such as alloys with nickel and/or cobalt. In addition to transition metal(s), the alloy may contain at least one further metal selected from Li, Na, K, Ca, Y, La, Ac, Al, Zn, Ga, Zr, Ag, Cd and In. The alloy may also contain non-metals or compound thereof, in particular one or more constituent selected from elemental and compounds of H, B, C, O, F, Si, P, As, Se and Te.

Suitable anodes comprising a transition metal-alloy with an integral oxide layer containing predominantly one or more transition metal oxides have been disclosed in the prior art, in particular in the above references, as well as in, WO00/40783 (de Nora/Duruz) and U.S. Pat. No. 6,077,415 (Duruz/de Nora). Suitable designs for metal-based anodes are disclosed in WO00/40781 and WO00/40782 (both de Nora).

As mentioned above, the anode has a transition metal-containing alloy that self-forms during normal electrolysis an integral electrochemically-active oxide-based surface layer containing predominantly one or more transition metal oxides which slowly dissolve in the electrolyte.

The rate of formation of this oxide layer is substantially equal to its rate of dissolution at the surface layer/electrolyte interface thereby maintaining its thickness substantially constant and forming a limited barrier controlling the oxidation rate.

Such an anode wear mechanism is disclosed in greater details in WO00/06805 and U.S. Pat. No. 6,248,227 (both de Nora/Duruz). By using the cell environment and operating conditions of the present invention the anode wear and corrosion can be significantly reduced.

During normal operation, the anode thus comprises a metallic (un-oxidised) anode body (or layer) on which and from which the oxide-based surface layer is formed.

The electrochemically active oxide-based surface layer may contain an oxide as such, or in a multi-compound mixed oxide and/or in a solid solution of oxides. The oxide may be in the form of a simple, double and/or multiple oxide, and/or in the form of a stoichiometric or non-stoichiometric oxide.

The oxide-based surface layer has several functions. Besides protecting in some measure the metallic anode body against chemical attack in the cell environment and its electrochemical function for the conversion of oxygen ions to molecular oxygen, the oxide-based surface layer controls the diffusion of oxygen which oxidises the anode body to further form the surface layer.

When the oxide-based surface layer is too thin, in particular at the start-up of electrolysis, the diffusion of oxygen towards the metallic body is such as to oxidise the metallic anode body at the surface layer/anode body interface with formation of the oxide-based surface layer at a faster rate than the dissolution rate of the surface layer into the electrolyte, allowing the thickness of the oxide-based surface layer to increase. The thicker the oxide-based surface layer becomes, the more difficult it becomes for oxygen to reach the metallic anode body for its oxidation and therefore the rate of formation of the oxide-based surface layer decreases with the increasing thickness of the surface layer. Once the rate of formation of the oxide-based surface layer has met its rate of dissolution into the electrolyte an equilibrium is reached at which the thickness of the surface layer remains substantially constant and during which the metallic anode body is oxidised at a rate which substantially corresponds to the rate of dissolution of the oxide-based surface layer into the electrolyte.

In contrast to carbon anodes, in particular pre-baked carbon anodes, the consumption of the anodes is at a very slow rate. Therefore, these slow consumable anodes in drained cell configurations do not need to be regularly repositioned in respect of their facing cathodes since the anode-cathode gap does not substantially change.

Advantageously, the anode body comprises an iron alloy which when oxidised will form an oxide-based surface layer containing iron oxide, such as hematite or a mixed ferrite-hematite, providing a good electrical conductivity and electrochemical activity, and a low dissolution rate in the electrolyte.

Optionally, the anode body may also comprise one or more additives selected from beryllium, magnesium, yttrium, titanium, zirconium, vanadium, niobium, tantalum, chromium, molybdenum, tungsten, manganese, rhodium, silver, aluminium, silicon, tin, hafnium, lithium, cerium and other Lanthanides.

Suitable kinds of anode materials which may be used for forming the oxide-based surface layer comprise high-strength low-alloy (HSLA) steels as disclosed in WO00/06805 (de Nora/Duruz) and WO00/40783 (de Nora/Duruz).

High-strength low-alloy (HSLA) steels are a group of low-carbon steels (typically up to 0.5 weight % carbon of the total) that contain small amounts of alloying elements. These steels have better mechanical properties and sometimes better corrosion resistance than carbon steels.

The high-strength low-alloy steel body may comprise 94 to 98 weight % iron and carbon, the remaining constituents being one or more further metals selected from chromium, copper, nickel, silicon, titanium, tantalum, tungsten, vanadium, zirconium, aluminium, molybdenum, manganese and niobium, and possibly small amounts of at least one additive selected from boron, sulfur, phosphorus and nitrogen.

The oxide-based surface layer may alternatively comprise ceramic oxides containing combinations of divalent nickel, cobalt, magnesium, manganese, copper and zinc with divalent/trivalent nickel, cobalt, manganese and/or iron. The ceramic oxides can be in the form of perovskites or non-stoichiometric and/or partially substituted or doped spinels, the doped spinels further comprising dopants selected from the group consisting of $Ti^{4+}$, $Zr^{4+}$, $Sn^{4+}$, $Fe^{4+}$, $Hf^{4+}$, $Mn^{4+}$, $Fe^{3+}$, $Ni^{3+}$, $Co^{3+}$, $Mn^{3+}$, $Al^{3+}$, $Cr^{3+}$, $Fe^{2+}$, $Ni^{2+}$, $Co^{2+}$, $Mg^{2+}$, $Mn^{2+}$, $Cu^{2+}$, $Zn^{2+}$ and $Li^{+}$.

The anode can also comprise a metallic anode body or layer which progressively forms the oxide-based surface layer on an inert, inner core made of a different electronically conductive material, such as metals, alloys, intermetallics, cermets and conductive ceramics.

In particular, the inner core may comprise at least one metal selected from copper, chromium, nickel, cobalt, iron, aluminium, hafnium, molybdenum, niobium, silicon, tantalum, tungsten, vanadium, yttrium and zirconium, and combinations and compounds thereof. For instance, the core may consist of an alloy comprising 10 to 30 weight % of chromium, 55 to 90 weight % of at least one of nickel, cobalt and/or iron and up to 15 weight % of at least one of aluminium, hafnium, molybdenum, niobium, silicon, tantalum, tungsten, vanadium, yttrium and zirconium.

Resistance to oxygen may be at least partly achieved by forming an oxygen barrier layer on the surface of the inner core by surface oxidation or application of a precursor layer and heat treatment. Known barriers to oxygen are chromium oxide, niobium oxide and nickel oxide.

Advantageously, the inner core is covered with an oxygen barrier layer which is in turn covered with at least one protective layer consisting of copper, or copper and at least one of nickel and cobalt, and/or oxide(s) thereof to protect the oxygen barrier layer by inhibiting its dissolution into the electrolyte.

The surface of the anode may be in-situ or ex-situ pre-oxidised, for instance in air or in another oxidising atmosphere or media, or it may be oxidised in a first electrolytic cell and then transferred into an aluminium production cell.

When the anode has a pre-oxidised surface layer which is thicker than its thickness during steady operation, the rate of formation of the oxide-based surface layer is initially less than its rate of dissolution but increases to reach it. Conversely, when the anode has an oxide-free surface or a pre-oxidised surface forming an oxide-based layer which is thinner than its thickness during steady operation, the rate of formation of the oxide-based surface layer is initially greater than its rate of dissolution but decreases to reach it.

The pre-oxidised surface layer may be of such a thickness that after immersion into the electrolyte and during electrolysis the thick oxide-based surface layer prevents the penetration of nascent monoatomic oxygen beyond the oxide-based surface layer. Therefore the mechanism for forming new oxide by further oxidation of the anode is delayed until the existing pre-oxidised surface layer has been sufficiently dissolved into the electrolyte at the surface layer/electrolyte interface, no longer forming a barrier to nascent oxygen.

Anode Design

In one embodiment, the anode has a highly conductive metallic structure with an active anode surface on which, during electrolysis, oxygen is anodically evolved, and which is suspended in the electrolyte substantially parallel to a facing cathode. Such metallic structure comprises a series of parallel horizontal anode members, each having an electrochemically active surface on which during electrolysis oxygen is anodically evolved, the electrochemically active surfaces being in a generally coplanar arrangement to form said active anode surface. The anode members are spaced laterally to form longitudinal flow-through openings for the circulation of electrolyte, in particular for the up-flow of alumina-depleted electrolyte driven by the upward fast escape of anodically evolved oxygen, and for the down-flow of alumina-rich electrolyte to an electrolysis zone spacing the anode(s) and the cathode.

Depending on the cell configuration some or all of the flow-through openings may serve for the flow of alumina-rich electrolyte to an electrolysis zone between the anode(s) and the cathode and/or for the flow of alumina-depleted electrolyte away from the electrolysis zone. When the anode surface is horizontal or inclined these flows are ascending and descending. Part of the electrolyte circulation may also take place around the metallic anode structure.

A substantially uniform current distribution can be provided from a current feeder through conductive transverse metallic connectors to the anode members and their active surfaces.

As opposed to known oxygen-evolving anode designs for aluminium electrowinning cells, in such an anode, the coplanar arrangement of the anode members provides an electrochemically active surface extending over an expanse which is much greater than the thickness of the anode members, thereby limiting the material cost of the anode.

The active anode surface may be substantially horizontal, vertical or inclined to the horizontal.

In special cases, the electrochemically active anode surface may be vertical or substantially vertical, the horizontal anode members being spaced apart one above the other, and arranged so the circulation of electrolyte takes place through the flow-through openings. For example, the anode members may be arranged like venetian blinds next to a vertical or substantially vertical cathode.

In one embodiment, two substantially vertical (or downwardly converging at a slight angle to the vertical) spaced apart adjacent anodes are arranged between a pair of substantially vertical cathodes, each anode and facing cathode being spaced apart by an inter-electrode gap. The adjacent anodes are spaced apart by an electrolyte down-flow gap in which alumina-rich electrolyte flows downwards until it circulates via the adjacent anodes' flow-through openings into the inter-electrode gaps. The alumina-rich electrolyte is electrolysed in the inter-electrode gaps thereby producing anodically evolved oxygen which drives alumina-depleted electrolyte up towards the surface of the electrolyte where the electrolyte is enriched with alumina, and induces the downward flow of alumina-rich electrolyte.

The anode members may be spaced-apart blades, bars, rods or wires. The bars, rods or wires may have a generally rectangular or circular cross-section, or have in cross-section an upper generally semi-circular part and a flat bottom. Alternatively, the bars, rods or wires may have a generally bell-shape or pear-shape cross-section.

Each blade, bar, rod or wire may be generally rectilinear or, alternatively, in a generally concentric arrangement, each blade, bar, rod or wire forming a loop to minimise edge effects of the current during use. For instance, each blade, bar, rod or wire can be generally circular, oval or polygonal, in particular rectangular or square, preferably with rounded corners.

Each anode member may be an assembly comprising an electrically conductive first or support member supporting or carrying at least one electrochemically active second member, the surface of the second member forming the electrochemical active surface. To avoid unnecessary mechanical stress in the assembly due to a different thermal expansion between the first and second members, the first member may support a plurality of spaced apart "short" second members.

The electrochemically active second member may be electrically and mechanically connected to the first support member by an intermediate connecting member such as a flange. Usually, the first member is directly or indirectly in contact with the electrochemically active second member along its whole length which minimises during cell operation the current path through the electrochemically active member. Such a design is particularly well suited for a second member made of an electrochemically active material which does not have a high electrical conductivity.

The parallel anode members are transversally connected by at least one transverse connecting member. Possibly the anode members are connected by a plurality of transverse connecting members which are in turn connected together by one or more cross members.

For concentric looped configurations, the transverse connecting members may be radial. In this case the radial connecting members extend radially from the middle of the parallel anode member arrangement and optionally are secured to or integral with an outer ring at the periphery of this arrangement.

Advantageously, the transverse connecting members are of variable section to ensure a substantially equal current density in the connecting members before and after each connection to an anode member. This also applies to the cross member when present.

Alternatively, the parallel anode members can be connected to one another for instance in a grid-like, net-like or mesh-like configuration of the anode members. To avoid edge effects of the current, the extremities of the anode members can be connected together, for example they can be arranged extending across a generally rectangular peripheral anode frame from one side to an opposite side of the frame.

In other designs, each anode comprises a vertical current feeder arranged to be connected to a positive bus bar which is mechanically and electrically connected to at least one transverse connecting member or to one or more cross members connecting a plurality of transverse connecting members, for carrying electric current to the anode members through the transverse connecting member(s) and, where present, through the cross member. Where no transverse connecting member is present the vertical current feeder is directly connected to the anode structure which can be a grid, net, mesh or a perforated plate.

The vertical current feeder, anode members, transverse connecting members and where present the cross members may be secured together for example by being cast as a unit. Assembly by welding or other mechanical connection means is also possible.

For all these anode designs, the anode's active layer obtained by surface oxidation of a metallic anode substrate is made of metal oxide such as iron oxide, and a sufficient amount of anode constituents may be maintained in the electrolyte to keep the anode(s) substantially dimensionally stable by reducing dissolution thereof into the electrolyte.

Cell Features

The cell may comprise at least one aluminium-wettable cathode. The aluminium-wettable cathode may be in a drained configuration. Examples of drained cathode cells are described in U.S. Pat. No. 5,683,130 (de Nora), WO99/02764 and WO99/41429 (both in the name of de Nora/Duruz).

The cell may also comprise means to facilitate dissolution of alumina fed into the electrolyte, for instance by using electrolyte guiding members above the anode members as described in PCT/IB99/00017 (de Nora), the content of which is disclosed in WO00/40781, inducing an up-flow and/or a down-flow of electrolyte through and possibly around the anode structure.

The electrolyte guide members may be secured together by being cast as a unit, welding or using other mechanical connecting means to form an assembly. This assembly can be connected to the vertical current feeder or secured to or placed on the foraminate anode structure.

The cell may also comprise means to thermally insulate the surface of the electrolyte to prevent the formation of an electrolyte crust on the electrolyte surface, such as an insulating cover above the electrolyte, as described in co-pending application WO98/02763 (de Nora/Sekhar).

The electrolyte of the aluminium production cell usually comprises sodium fluoride and aluminium fluoride, in particular cryolite, possibly with at least one further fluoride selected from fluorides of calcium, lithium and magnesium. The electrolyte can be at temperature in the range from 660° to 1000° C., in particular from 720° to 960° C., preferably from 850° to 940° C. Examples of electrolyte compositions are given in U.S. Pat. No. 4,681,671 (Duruz), U.S. Pat. No. 5,725,744 (de Nora/Duruz) and in the abovementioned WO00/06802.

FURTHER ASPECTS OF THE INVENTION

The invention also relates to a method of electrowinning aluminium in a cell for the production of aluminium from alumina dissolved in a sodium ion-containing molten electrolyte. Such a cell comprises a cathodic material that is predominately active for the reduction of sodium ions rather than aluminium ions and an oxygen-evolving anode that comprises a transition metal-containing alloy having an integral oxide layer containing predominantly one or more transition metal oxides which are slowly dissolved in the electrolyte and compensated by oxidation of the alloy at the alloy/oxide layer interface. This method comprises using a sodium-inert layer on the cathodic material to inhibit dissolution of the anode, as described above and cathodically producing aluminium.

Anodes of the present invention may be covered with an iron oxide-based material, in particular hematite-based, obtained by oxidising the surface of an anode substrate which contains iron. Suitable anode materials are described in PCT/IB99/00015 (de Nora/Duruz) and PCT/IB99/00016 (Duruz/de Nora) the contents of which are published in WO00/40783 and WO00/06803 respectively. These two patent applications disclose the use for aluminium electrowinning of a metal iron-alloy anode having an integral electrochemically active oxide layer which during operation is progressively further formed by surface oxidation of the anode's iron-alloy by controlled oxygen diffusion through the electrochemically active oxide layer, and is progressively dissolved into the electrolyte at the electrolyte/anode interface.

Furthermore, the invention generally concerns cells for the production of aluminium from alumina dissolved in an sodium ion-containing molten electrolyte. The cells comprise a cathodic material, in particular carbon, that is predominately active for the reduction of sodium ions rather than aluminium ions and an oxygen-evolving anode that comprises a transition metal-containing alloy having an integral oxide layer containing predominantly one or more transition metal oxides which slowly dissolve in the electrolyte and are compensated by oxidation of the alloy at the alloy/oxide layer interface.

More particularly, the invention relates to the use in such a cell of a sodium-inert layer on the sodium-active cathodic material as a dissolution inhibitor of the anode. This sodium-inert layer is active for the cathodic reduction of aluminium ions rather than sodium ions and inhibits the presence in the molten electrolyte of soluble cathodically-produced sodium metal that constitutes an agent for chemically reducing the anode's transition metal oxides and the anodically-evolved oxygen, in particular molecular oxygen, thereby inhibiting reduction of the anode's transition metal oxides by sodium metal and maintaining the evolved oxygen at the anode at a concentration such as to produce at the alloy/oxide layer interface stable and coherent transition metal oxides having a high level of oxidation.

A further aspect of the invention relates to a cell for the production of aluminium from alumina dissolved in a molten electrolyte comprising ions of at least one metal selected from sodium, lithium and potassium. The cell comprises a cathodic material that is predominately active for the reduction of such electrolyte metal ions rather than aluminium ions and an oxygen-evolving anode that comprises a transition metal-containing alloy having an integral oxide layer containing predominantly one or more transition metal oxides which slowly dissolve in the electrolyte and are compensated by oxidation of the alloy at the alloy/oxide layer interface.

More specifically the invention relates to a use in such a cell of a layer that is inert to these electrolyte metal ions on such a cathodic material as a dissolution inhibitor of the anode. This inert layer is active for the cathodic reduction of aluminium ions rather than the electrolyte metal ions to inhibit the presence in the molten electrolyte of soluble cathodically-reduced electrolyte metal ions that act as agents for chemically reducing the anode's transition metal oxides and the evolved oxygen, in particular molecular oxygen, thereby inhibiting reduction of the anode's transition metal oxides by said cathodically-reduced electrolyte metal ions and maintaining the evolved oxygen at the anode at a concentration such as to produce at the alloy/oxide layer interface stable and coherent transition metal oxides having a high level of oxidation.

Yet another aspect of the invention relates to a method of inhibiting dissolution of an oxygen-evolving anode of a cell for the production of aluminium from alumina dissolved in an molten electrolyte comprising ions of at least one metal selected from sodium, lithium and potassium. This cell comprises a cathodic material that is predominately active for the reduction of such electrolyte metal ions rather than aluminium ions. The oxygen-evolving anode comprises a transition metal-containing alloy having an integral oxide layer containing predominantly one or more transition metal oxides which slowly dissolve in the electrolyte and are compensated by oxidation of the alloy at the alloy/oxide layer interface.

The method of the invention comprises providing a layer that is inert to these electrolyte metal ions on such a cathodic material and electrolysing the dissolved alumina whereby oxygen is anodically evolved and aluminium ions rather than these electrolyte metal ions are cathodically reduced on this inert layer to inhibit the presence in the molten electrolyte of soluble cathodically-reduced electrolyte metal ions that constitute agents for chemically reducing the anode's transition metal oxides and evolved oxygen, in particular molecular oxygen. The inert layer is used as a dissolution inhibitor of the anode by its effect in inhibiting reduction of the anode's transition metal oxides by said cathodically-reduced electrolyte metal ions and in maintaining the evolved oxygen at the anode at a concentration such as to produce at the alloy/oxide layer interface stable and coherent transition metal oxides having a high level of oxidation.

Yet a further aspect of the invention relates to a cell for the production of aluminium from alumina dissolved in a molten electrolyte. The cell comprises a carbon-based material that is reactable with oxygen, in particular molecular oxygen, and/or carbon dioxide, to form carbon monoxide, or that produces carbon dust, and an oxygen-evolving anode that comprises a transition metal-containing alloy having an integral oxide layer containing predominantly one or more transition metal oxides which slowly dissolve in the electrolyte and are compensated by oxidation of the alloy at the alloy/oxide layer interface, More particularly the invention relates to the use in such a cell of an oxygen-stable layer on the carbon-based material as a dissolution inhibitor of the anode. The oxygen-stable layer inhibits the presence in the molten electrolyte of carbon dust or carbon monoxide that constitutes an agent for chemically reducing the anode's transition metal oxides and the evolved oxygen, in particular molecular oxygen to form carbon dioxide, thereby inhibiting reduction of the anode's transition metal oxides by the carbon dust or carbon monoxide and maintaining the evolved oxygen at the anode at a concentration such as to produce at the alloy/oxide layer interface stable and coherent transition metal oxides having a high level of oxidation.

Furthermore, the invention relates to a method of inhibiting dissolution of an oxygen-evolving anode of a cell for the production of aluminium from alumina dissolved in an molten electrolyte. The cell comprises carbon-based material that is reactable with oxygen, in particular molecular oxygen, and/or carbon dioxide, or that produces carbon dust. The oxygen-evolving anode comprises a transition metal-containing alloy having an integral oxide layer containing predominantly one or more transition metal oxides which slowly dissolve in the electrolyte and are compensated by oxidation of the alloy at the alloy/oxide layer interface.

According to the invention, the method comprises providing an oxygen-stable layer on the carbon-based material and electrolysing the dissolved alumina whereby oxygen is anodically evolved and aluminium ions are cathodically reduced. The oxygen-stable layer inhibiting the presence in the molten electrolyte of the carbon dust or carbon monoxide that constitutes an agent for chemically reducing the anode's transition metal oxide and the evolved oxygen, in particular molecular oxygen, to form carbon dioxide. The oxygen stable layer is used as a dissolution inhibitor of the anode by its effect in inhibiting reduction of the anode's transition metal oxides by the carbon dust or carbon monoxide and in maintaining the evolved oxygen at the anode at a concentration such as to produce at the alloy/oxide layer interface stable and coherent transition metal oxides having a high level of oxidation.

This oxygen-stable layer can comprise nitrides and/or carbides, such as silicon nitride, silicon carbide and/or boron nitride, or a stable oxide such as fused alumina. The oxygen-stable layer may comprise an aluminium-wetted coating, the aluminium retained in the coating forming a barrier to oxygen.

For example, the cell comprises sidewalls made of a carbon-based material which produces carbon dust that is reactable with oxygen.

Furthermore, the carbon dust, carbon monoxide, sodium, lithium or potassium may be oxidised by the anodic current which reduces the cell's current efficiency. Therefore, the sodium-inert layer may also inhibit reduction of the anode's transition metal oxides by sodium metal.

Additionally, the abovementioned carbon dust, carbon monoxide, sodium, lithium or potassium metal in the electrolyte at the anode may chemically reduce oxides of the anode's surface which causes corrosion of the anode. Sodium, lithium or potassium metal may also be oxidised in the electrolyte by the anodic current which reduces the cell's current efficiency. Therefore, the sodium-inert layer also inhibits reduction of the anode's transition metal oxides and increases the current efficiency.

BRIEF DESCRIPTION OF THE DRAWINGS

The invention will now be described by way of example with reference to the accompanying schematic drawings, in which.

DETAILED DESCRIPTION

Figure 1:
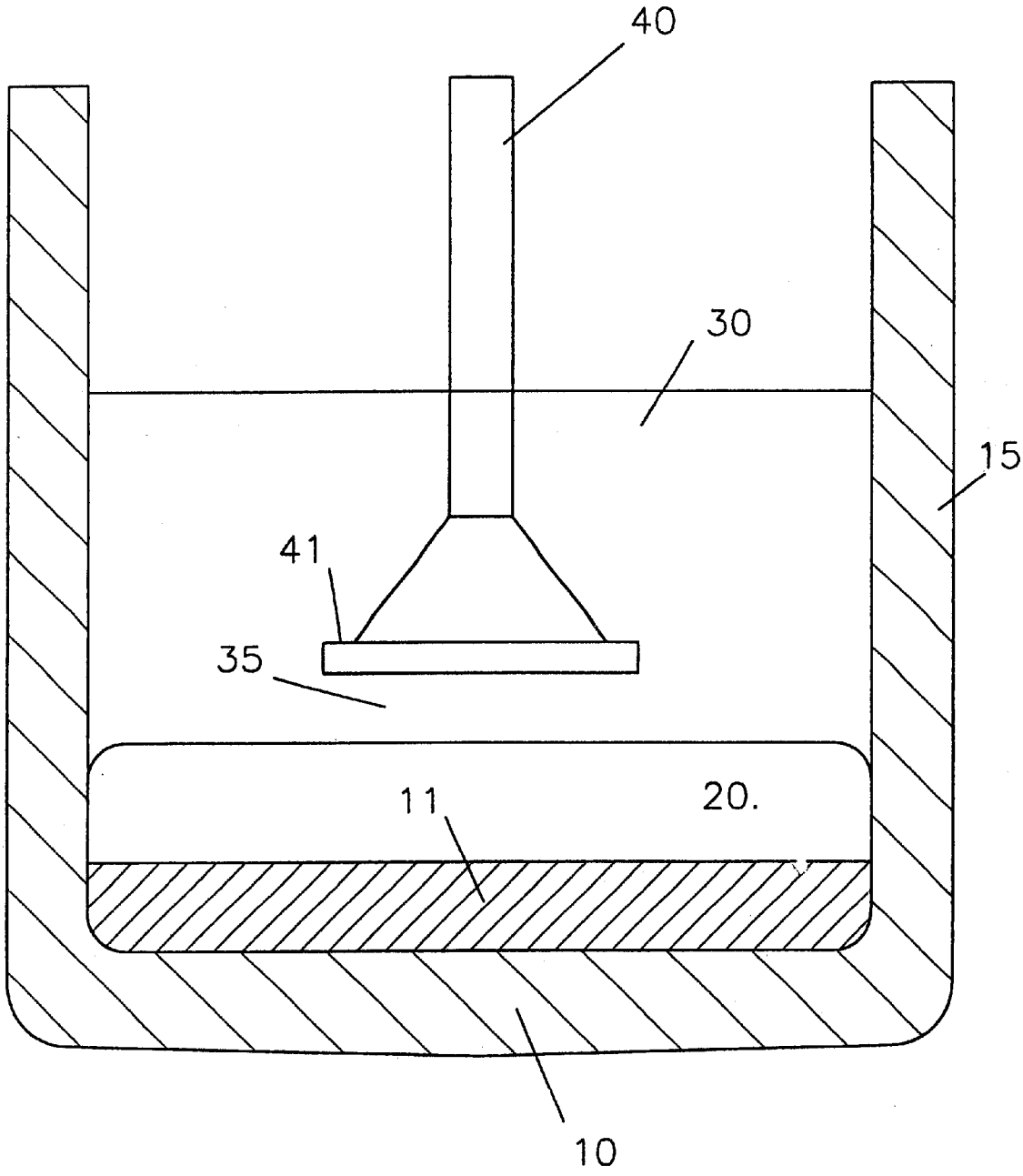
FIG. 1 shows a comparative laboratory scale cell for the production of aluminium which uses an oxygen-evolving anode in a cathodically polarised carbon receptacle containing a cathodic layer of molten aluminium covered with a cryolite-based electrolyte.
Figure 2:
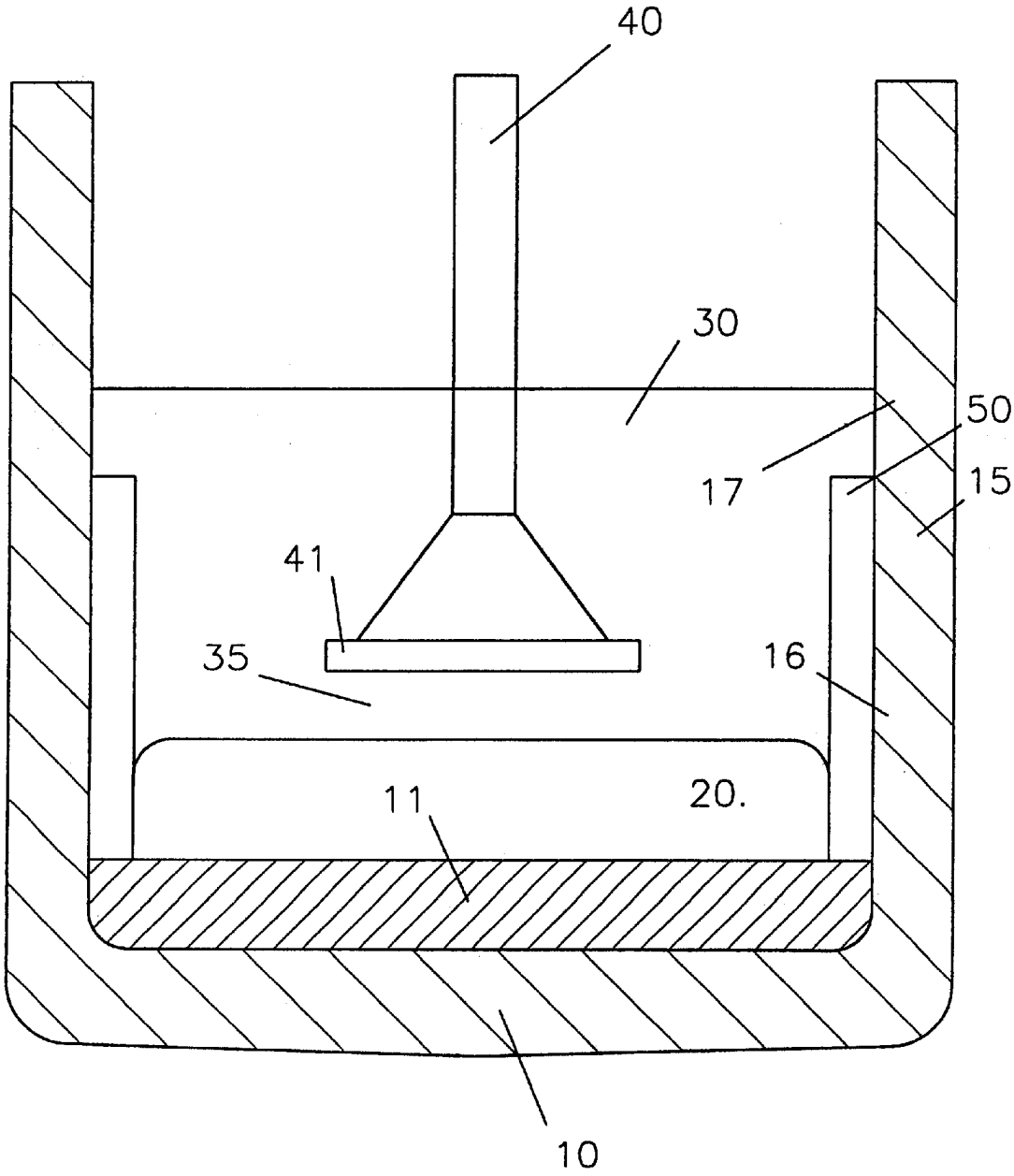
FIG. 2 shows the laboratory scale cell of FIG. 1 in which an additional inner vertical wall of fused alumina covers and shields the cathodically polarised lower part of the carbon receptacle according to the invention.
Figure 3:
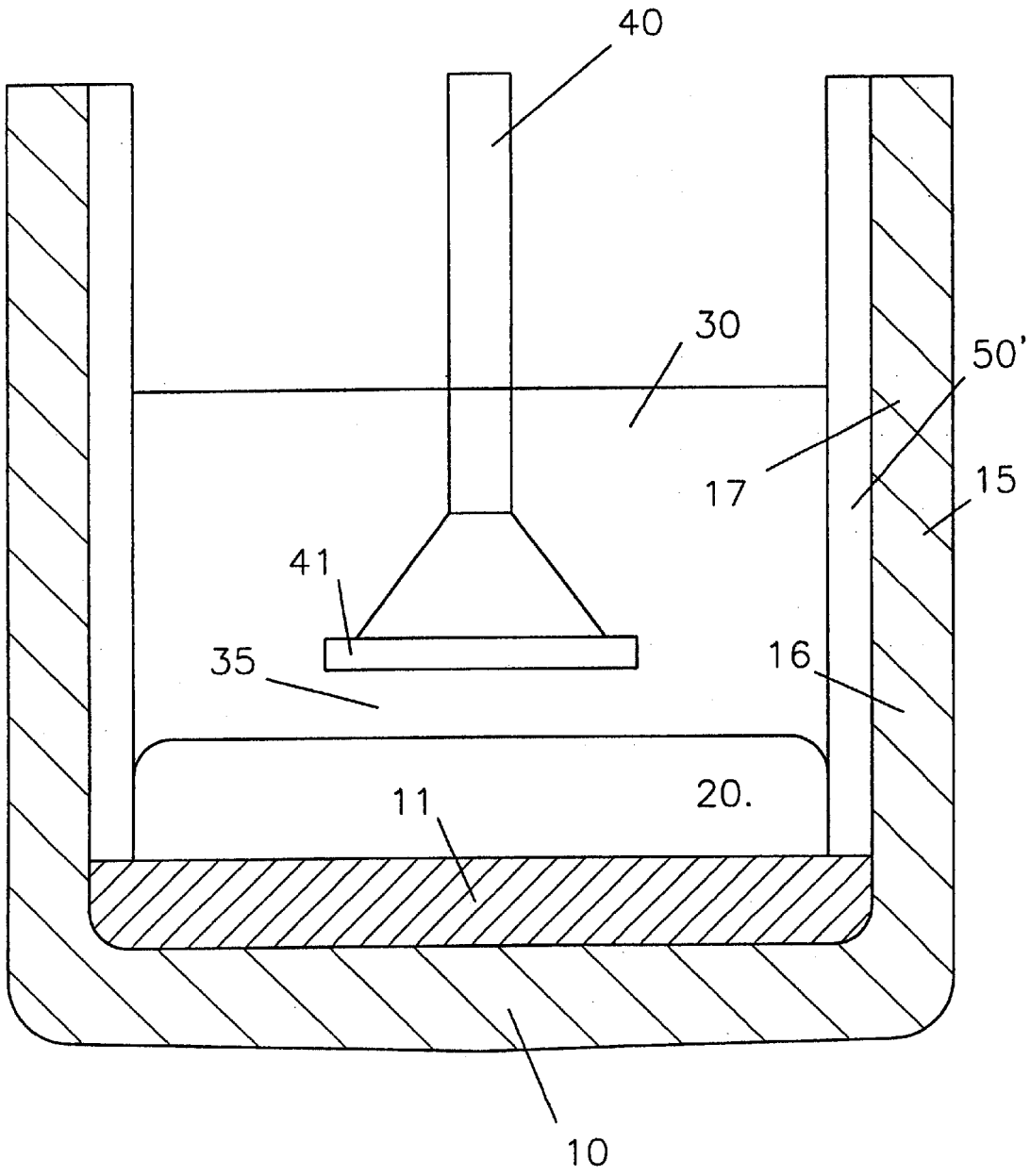
FIG. 3 shows the laboratory scale cell of FIG. 2 in which the additional inner vertical wall of fused alumina extends also over the cathodically non-polarised upper part of the carbon receptacle above the molten electrolyte according to the invention.

FIGS. 1, 2 and 3 show three laboratory scale cells having a graphite cathodic receptacle 10 whose bottom is rendered aluminium-wettable by a boride-based layer 11. The boride-based layer 11 is covered with a pool of cathodically produced aluminium 20. The cathodic receptacle contains a cryolite-based molten electrolyte 30 in which alumina is dissolved.

An oxygen-evolving anode 40 is suspended in the molten electrolyte 30 spaced above the cathodic aluminium 20 by an anode-cathode gap 35. The anode has a grid-like active structure 41, for example as disclosed in FIGS. 4*a* and 4*b* as well as in WO00/40781 and WO00/40782 (both de Nora), which is made of a transition metal-containing alloy having an integral oxide layer containing predominantly one or more transition metal oxides which slowly dissolve in the electrolyte and are compensated by oxidation of the alloy at the alloy/oxide layer interface.

During use alumina is electrolysed in the anode-cathode gap 35 to produce oxygen on the active anode structure 41 and aluminium on the aluminium layer 20.

In FIG. 1, the sidewalls 15 of the carbon cathodic receptacle 10 are exposed to the molten electrolyte 30.

During use the bottom part 16 of sidewalls 15 are cathodically polarised. Thus, as discussed above, sodium ions rather than aluminium ions are cathodically reduced thereon.

In FIG. 2, the bottom part 16 of the sidewalls 15 is covered with a sleeve 50 made of fused alumina which is substantially resistant to molten electrolyte 30. The sidewall upper part 17 is insufficiently polarised for any cathodic activity and directly exposed to the molten electrolyte 30.

In FIG. 3, the bottom and the upper part 16, 17 of the sidewalls 15 are covered with a sleeve 50' made of fused alumina which is substantially resistant to molten electrolyte 30. Thus in the cell of FIG. 3, neither active nor passive carbon surfaces are exposed to the molten electrolyte 30.

Figure 4A:
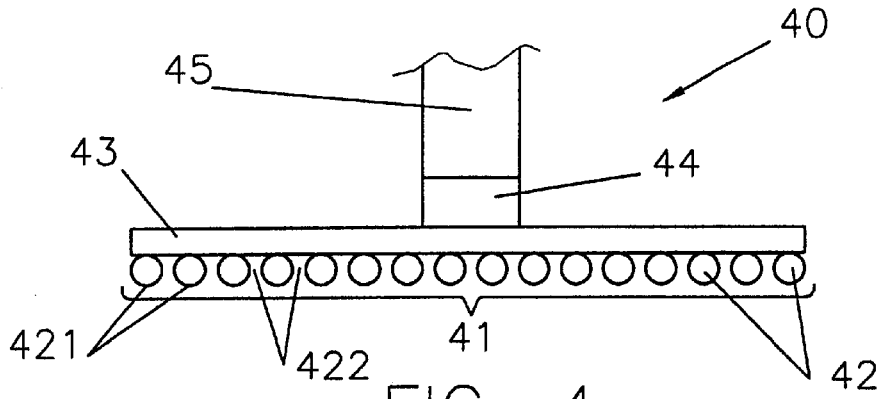
FIGS. 4*a* and 4*b* show respectively a side elevation and a plan view of an anode which can be used for electrowinning aluminium according to the invention.
Figure 4B:
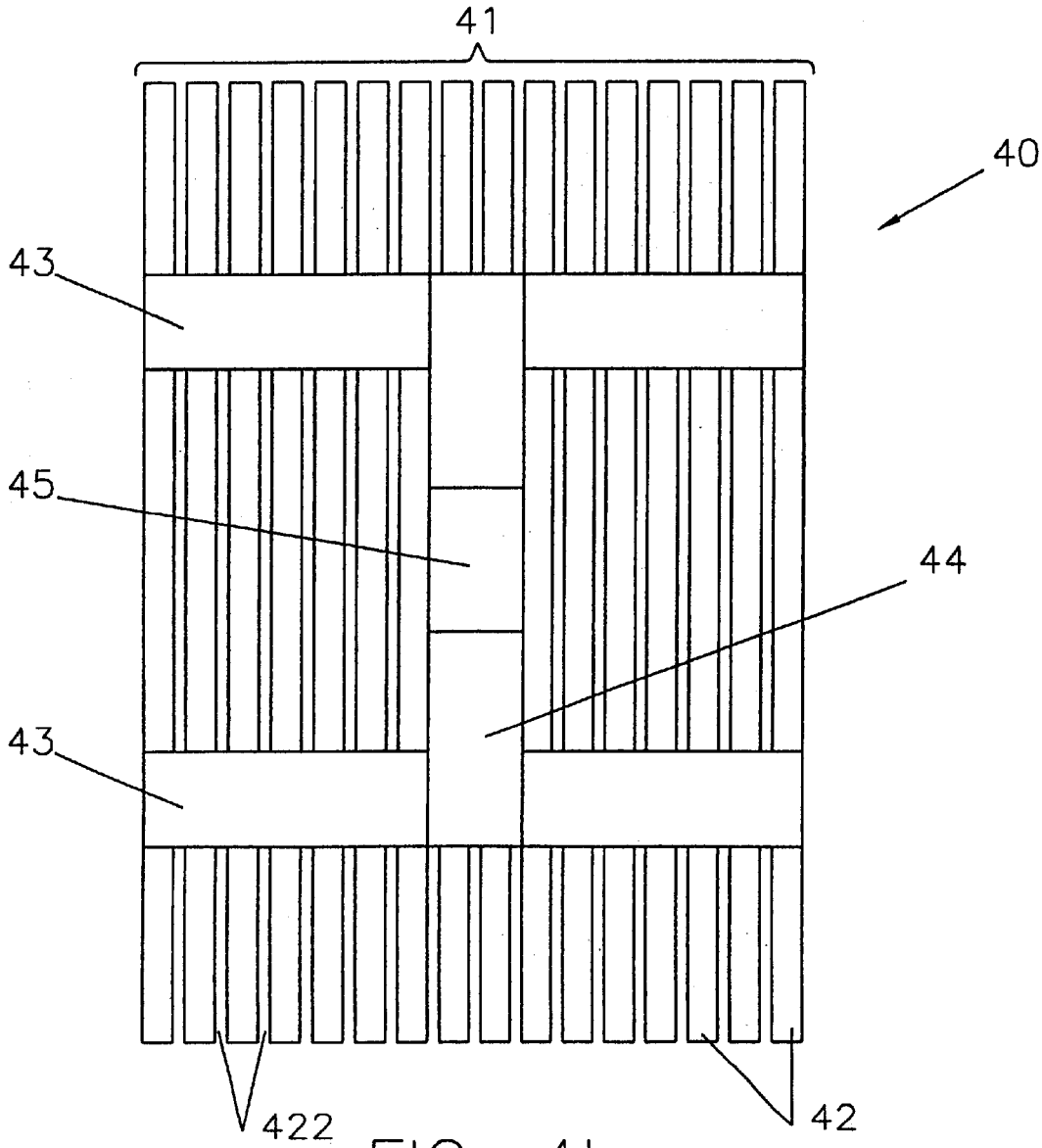

FIGS. 4*a* and 4*b* schematically show an anode 10 for use in the electrowinning of aluminium according to the invention, in particular in the cells of FIGS. 1 to 3.

The anode 40 comprises a vertical current feeder 45 for connecting the anode to a positive bus bar, a cross member 44 and a pair of transverse connecting members 43 for connecting the anode's active structure 41 made of a series of anode members 42.

The anode members 42 have an electrochemically active lower surface 421 where oxygen is anodically evolved during cell operation. The anode members 42 are in the form of parallel rods in a coplanar arrangement, laterally spaced apart from one another by inter-member gaps 422. The inter-member gaps 422 constitute flow-through openings for the circulation of electrolyte and the escape of anodically-evolved gas released at the electrochemically active surfaces 421.

The anode members 42 are transversally connected by the pair of transverse connecting members 43 which are in turn connected together by the cross member 44 on which the vertical current feeder 45 is mounted. The current feeder 45, the cross member 44, the transverse connecting members 43 and the anode members 42 are mechanically secured together by welding, rivets or other means.

As described above, the electrochemically active surface 421 of the anode members 42 can be iron-oxide based, such as hematite-based, in particular as described in PCT/IB99/00015 (de Nora/Duruz) and PCT/IB99/00016 (Duruz/de Nora) mentioned above.

The cross-member 44 and the transverse connecting members 43 are so designed and positioned over the anode members 42 to provide a substantially even current distribution through the anode members 42 to their electrochemically active surfaces 421. The current feeder 45, the cross-member 44 and the transverse connecting members 43 do not need to be electrochemically active and their surface may passivate when exposed to electrolyte. However they should be electrically well conductive to avoid unnecessary voltage drops and should not substantially dissolve in electrolyte.

When the anode members 42 and the cross-members 43 are exposed to different thermal expansion, each anode member 42 may be made into two (or more where appropriate) separate "short" anode members. The "short" anode members should be longitudinally spaced apart when the thermal expansion of the anode members is greater than the thermal expansion of the cross-members.

Alternatively, it may be advantageous in some cases, in particular to enhance the uniformity of the current distribution, to have more than two transverse connecting members 43 and/or a plurality of cross-members 44.

Also, it is not necessary for the two transverse connecting members 43 to be perpendicular to the anode members 42 in an parallel configuration as shown in FIG. 4. The transverse connecting members may be in an X configuration in which each connecting member extends from one corner to the opposite corner of a rectangular or square anode structure, a vertical current feeder being connected to the intersection of the connecting members.

Figure 5:
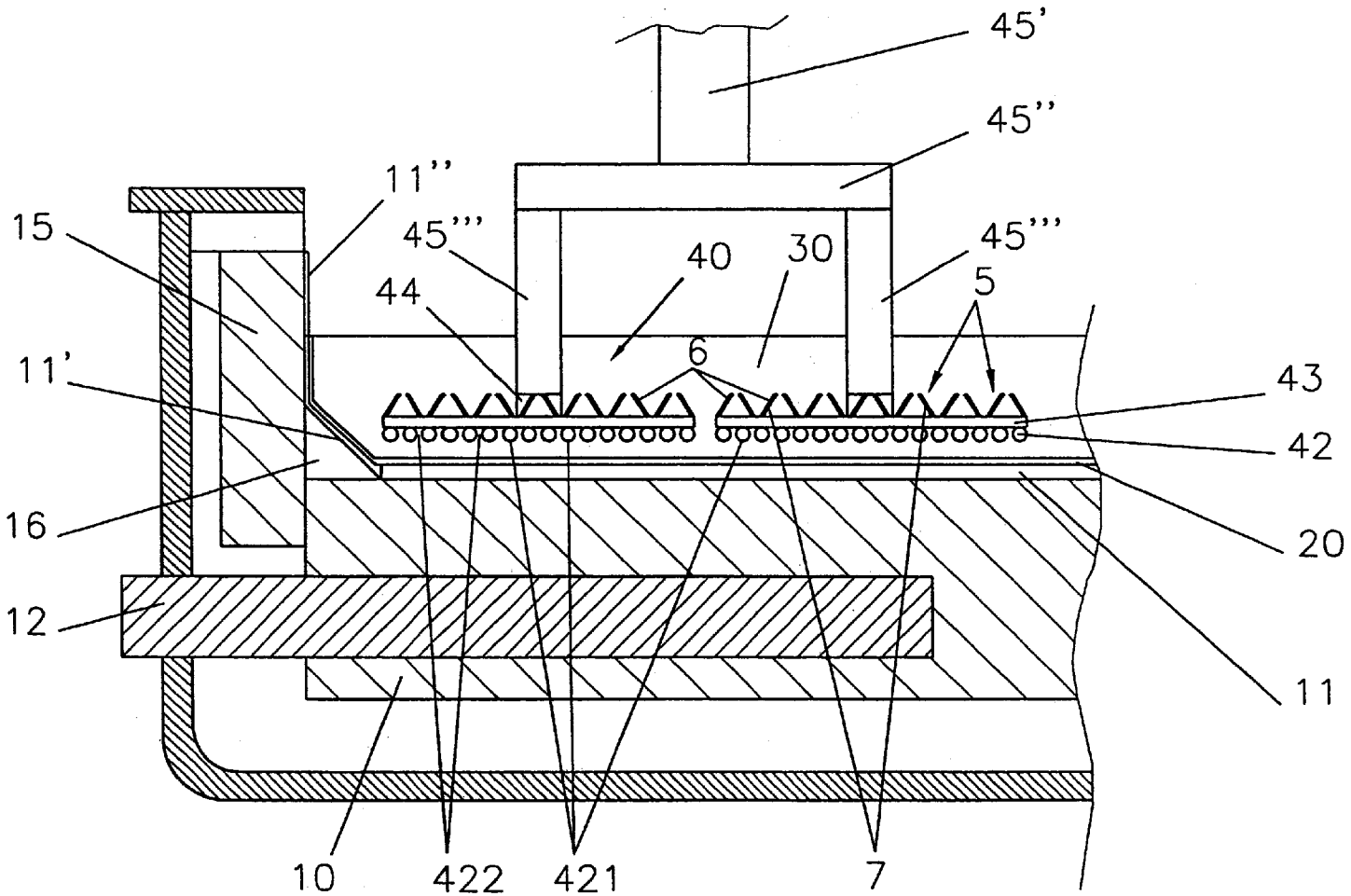
FIG. 5 shows an aluminium electrowinning cell operating according to the invention.

FIG. 5 shows an aluminium electrowinning cell operatable according to the invention and which has a series of anodes 40 which are similar to those shown in FIGS. 4*a* and 4*b*, immersed in an electrolyte 30. The anodes 40 face a cathode cell bottom 10 connected to a negative busbar by current conductor bars 12. The cathode cell bottom 10 is made of graphite or other carbonaceous material coated with an aluminium-wettable refractory cathodic coating 11 on which aluminium 20 is produced and from which it drains or on which it forms a shallow pool, a deep pool or a stabilised pool. The molten produced aluminium 35 is spaced apart from the facing anodes 40 by an inter-electrode gap.

Pairs of anodes 40 are connected to a positive bus bar through a primary vertical current feeder 45' and a horizontal current distributor 45" connected at both of its ends to a foraminate anode 40 through a secondary vertical current distributor 45'".

The secondary vertical current distributor 45'" is mounted on the anode structure 42, 43, 44, on a cross member 44 which is in turn connected to a pair of transverse connecting members 43 for connecting a series of anode members 42. The current feeders 45', 45", 45'", the cross member 44, the transverse connecting members 43 and the anode members 42 are mechanically secured together by welding, rivets or other means.

The anode members 42 have an electrochemically active lower surface 421 on which during cell operation oxygen is anodically evolved. The anode members 42 are in the form of parallel rods in a foraminate coplanar arrangement, laterally spaced apart from one another by inter-member gaps 422. The inter-member gaps 422 constitute flow-through openings for the circulation of electrolyte and the escape of anodically-evolved gas from the electrochemically active surfaces 421.

The cross-member 44 and the transverse connecting members 43 provide a substantially even current distribution through the anode members 42 to their electrochemically active surfaces 421. The current feeder 45, the cross-member 44 and the transverse connecting members 43 do not need to be electrochemically active and their surface may passivate when exposed to electrolyte. However they should be electrically well conductive to avoid unnecessary voltage drops and should not substantially dissolve in the molten electrolyte.

The active surface 421 of the anode members 42 can be iron oxide-based, in particular hematite-based. Suitable anode materials are described in PCT/IB99/00015 (de Nora/Duruz) and PCT/IB99/00016 (Duruz/de Nora) mentioned above.

The iron oxide surface may extend over all immersed parts 42, 43, 44, 45'" of the anode 40, in particular over the immersed part of the secondary vertical current distributor 45'" which is preferably covered with iron oxide at least up to 10 cm above the surface of the electrolyte 30.

The immersed but inactive parts of the anode 40 may be further coated with zinc oxide. However, when parts of the anode 40 are covered with zinc oxide, the concentration of dissolved alumina in the electrolyte 30 should be maintained above 4 weight % to prevent excessive dissolution of zinc oxide in the electrolyte 30.

The core of all anode components 42, 43, 44, 45', 45", 45'" is preferably highly conductive and may be made of copper protected with successive layers of nickel, chromium, nickel, copper and optionally a further layer of nickel.

The anodes 40 are further fitted means for enhancing dissolution of fed alumina in the form of electrolyte guide members 5 formed of parallel spaced-apart inclined baffles 5 located above and adjacent to the foraminate anode structure 42, 43, 44. The baffles 5 provide upper downwardly converging surfaces 6 and lower upwardly converging surfaces 7 that intercept gaseous oxygen which is anodically produced below the electrochemically active surface 421 of the anode members 42 and which escapes between the inter-member gaps 422 through the foraminate anode structure 42,43,44. The oxygen released above the baffles 5 promotes dissolution of alumina fed into the electrolyte 30 above the downwardly converging surfaces 6.

The aluminium-wettable cathodic coating 11 of the cell shown in FIG. 5 can advantageously be a slurry-applied refractory hard metal coating as disclosed in U.S. Pat. Nos. 5,217,583, 5,364,513 (both in the name of Sekhar/de Nora) and in U.S. Pat. No. 5,651,874 (de Nora/Sekhar). Preferably, the aluminium-wettable cathodic coating 11 consists of a thick coating of refractory hard metal boride such as $TiB_2$, as disclosed in WO98/17842 (Sekhar/Duruz/Liu), which is particularly well suited to protect the cathode bottom of a drained cell as shown in FIG. 5. Outstanding performances have been observed with the highly aluminium-wettable coatings disclosed in WO01/42168 (de Nora/Duruz) or WO01/42531 (Nguyen/Duruz/de Nora). Alternatively, the sidewalls can be shielded from the molten electrolyte by a frozen electrolyte ledge.

The cell also comprises sidewalls 15 of carbonaceous material. The sidewalls 15 are coated/impregnated above the surface of the electrolyte 30 with a boron or a phosphate protective coating/impregnation 11" as described in U.S. Pat. No. 5,486,278 (Manganiello/Duruz/Bellò) and in U.S. Pat. No. 5,534,130 (Sekhar).

Below the surface of the electrolyte 30 the sidewalls 15 are coated with an aluminium-wettable coating 11', so that molten aluminium 20 driven by capillarity and magnetohydrodynamic forces covers and protects the sidewalls 15 from the electrolyte 30. The aluminium-wettable coating 11' extends from the aluminium-wettable cathodic coating 11 over the surface of connecting corner prisms 16 up the sidewalls 15 at least to the surface of the electrolyte 30. The aluminium-wettable side coating 11' may be advantageously made of an applied and dried and/or heat treated slurry of particulate $TiB_2$ in colloidal silica which is highly aluminium-wettable, for example as disclosed in WO01/42168 (de Nora/Duruz) or WO01/42531 (Nguyen/Duruz/de Nora).

As shown in FIG. 5, the carbonaceous sidewalls 15 and cathode bottom 10 are covered with aluminium-wettable material 11 and 11' and molten aluminium 20 which shield the carbonaceous material. The aluminium-wettable material 11 and 11' and the molten aluminium 20 inhibit dissolution of the anodes 40 as described above.

During cell operation, alumina is fed to the electrolyte 30 all over the baffles 5 and the metallic anode structure 42, 43, 44. The fed alumina is dissolved and distributed from the bottom end of the converging surfaces 6 through the inter-member gaps 422 into the inter-electrode gap through the inter-member gaps 422 and around edges of the metallic anode structure 42, 43, 44, i.e. between neighbouring pairs of anodes 40 or between peripheral anodes 40 and sidewalls 15. The dissolved alumina is electrolysed in the inter-electrode gap to produce oxygen on the electrochemically active anode surfaces 421 and aluminium which is incorporated into the cathodic molten aluminium 20. The oxygen evolved from the active surfaces 421 escapes through the inter-member gaps 422 and is intercepted and deflected by the upwardly converging surfaces 7 of baffles 5. The oxygen escapes from the uppermost ends of the upwardly converging surfaces 7 enhancing dissolution of the alumina fed over the downwardly converging surfaces 6.

Figure 8:
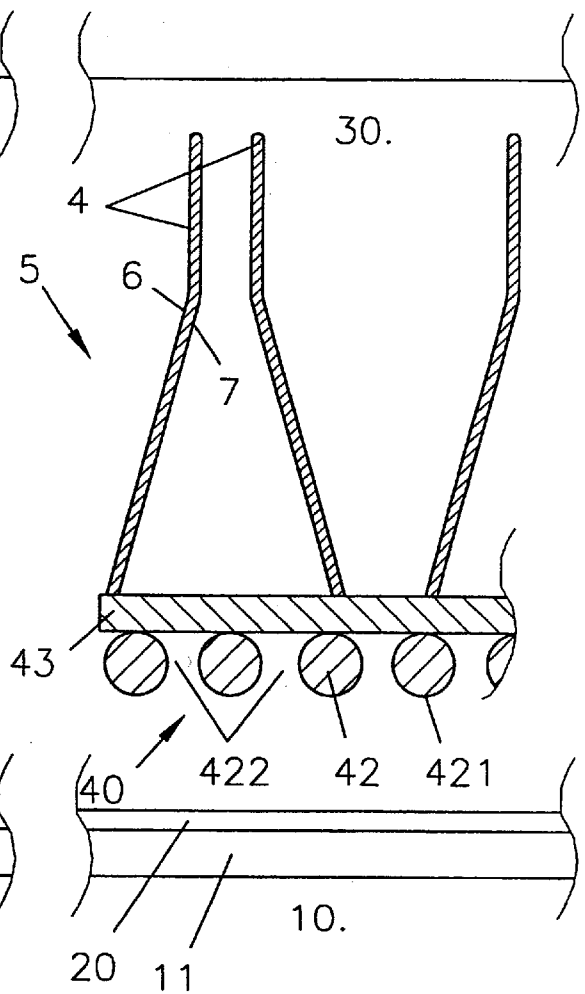
FIGS. 6, 7 and 8 are enlarged views of parts of variations of the anodes of FIG. 5 shown during cell operation for FIG. 6.
Figure 7:
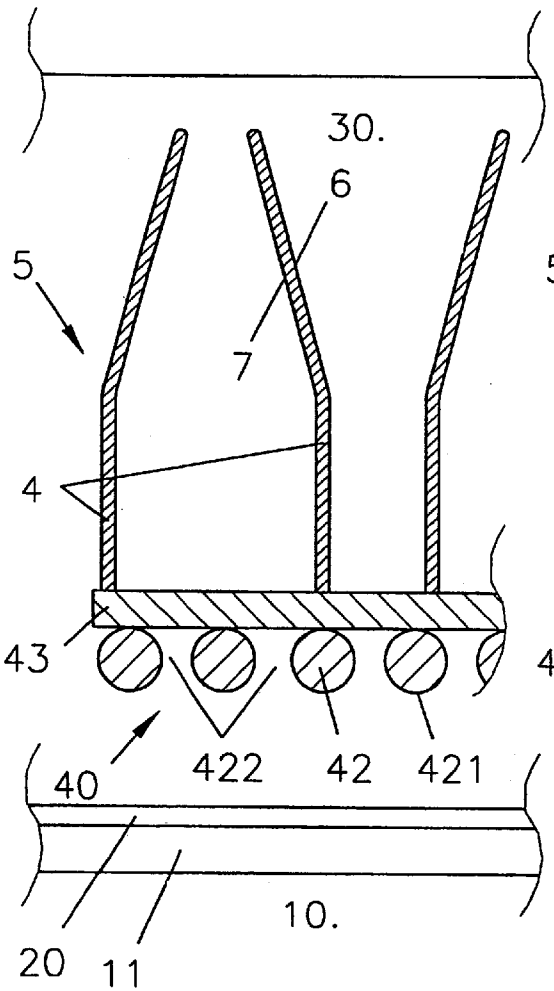
Figure 6:
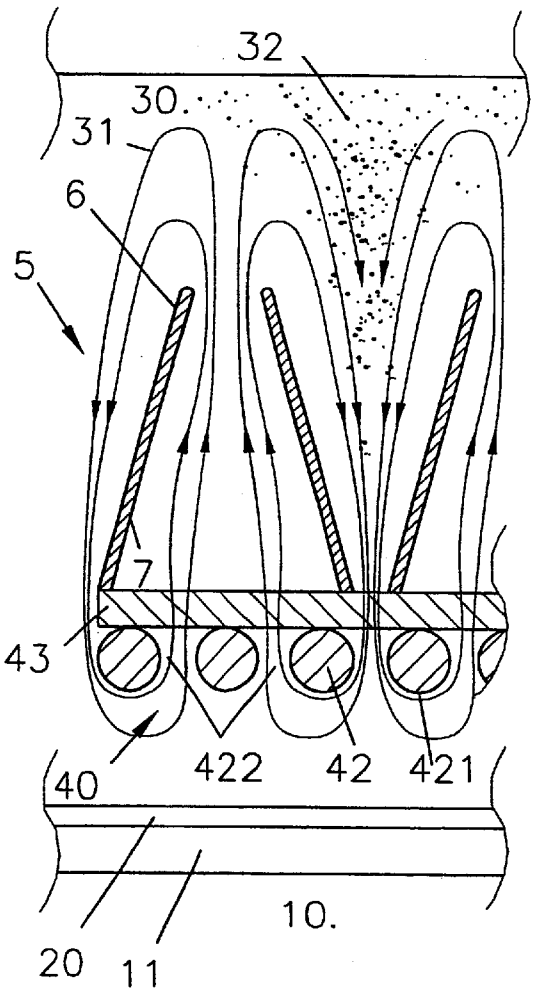

The aluminium electrowinning cells partly shown in FIGS. 6, 7 and 8 are similar to the aluminium electrowinning cell shown in FIG. 5.

In FIG. 6 the guide members are inclined baffles 5 as shown in FIG. 5. In this example the uppermost end of each baffle 5 is located just above mid-height between the surface of the electrolyte 30 and the transverse connecting members 43.

Also shown in FIG. 6, an electrolyte circulation 31 is generated by the escape of gas released from the active surfaces 421 of the anode members 15 between the inter-member gaps 422 and which is intercepted by the upward converging surfaces 7 of the baffles 5 confining the gas and the electrolyte flow between their uppermost edges. From the uppermost edges of the baffles 5, the anodically evolved gas escapes towards the surface of the electrolyte 30, whereas the electrolyte circulation 31 flows down through the downward converging surfaces 6 to compensate the depression created by the anodically released gas below the active surfaces 421 of the anode members 42. The electrolyte circulation 31 draws down into the inter-electrode gap dissolving alumina particles 32 which are fed above the downward converging surfaces 6.

FIG. 7 shows part of an aluminium electrowinning cell with baffles 5 operating as electrolyte guide members like those shown in cell of FIG. 6 but whose surfaces are only partly converging. The lower sections 4 of the baffles 5 are vertical and parallel to one another, whereas their upper sections have upward and downward converging surfaces 6,7. The uppermost end of the baffles 5 are located below but close to the surface of the electrolyte 30 to increase the turbulence at the electrolyte surface caused by the release of anodically evolved gas.

FIG. 8 shows a variation of the baffles shown in FIG. 11, wherein parallel vertical sections 4 are located above the converging surfaces 6,7.

By guiding and confining anodically-evolved oxygen towards the surface of the electrolyte 30 with baffles or other confinement means as shown in FIGS. 11 and 12 and as further described in PCT/IB99/00017 (de Nora) whose content is published in WO00/40781, oxygen is released so close to the surface as to created turbulences above the downwardly converging surfaces 6, promoting dissolution of alumina fed thereabove.

It is understood that the electrolyte confinement members 5 shown in FIGS. 5, 6, 7 and 8 can either be elongated baffles, or instead consist of a series of vertical chimneys of funnels of circular or polygonal cross-section.

The invention will be further described in the following Examples using the same anode materials in different cells.

Transition Metal Alloy Anode

Three identical anodes were made of a nickel-iron alloy which consisted of 50 weight % nickel, 0.3 weight % manganese, 0.5 weight silicon and 1.7 weight % yttrium, the balance being iron, which was pre-oxidised in air at a temperature of 1100° C. for 3 hours to form a transition metal oxide-based integral layer thereon.

EXAMPLE 1 (COMPARATIVE)

One of the above identical nickel-iron alloy anodes 40 was used in a cell, as shown in FIG. 1, having cathodically polarised carbon sidewalls 15 exposed to the molten electrolyte 30.

The electrolytic bath 30 consisted of 16 weight % $AlF_3$, 4 weight % $caF_2$ and 6 to 6.5 weight % dissolved $Al_2O_3$, the balance being cryolite ($Na_3AlF_6$), and was at a temperature of 930° C. The aluminium layer 20 had a thickness of about 3 cm.

Electrolysis was performed at constant current corresponding to an anodic current density of 0.8 A/cm$^2$ whereby oxygen was anodically evolved and aluminium 20 cathodically produced by electrolysis of the dissolved alumina.

The composition of the bath 30 was analysed every 12 hours by x-ray fluorescence (XRF). The $Al_2O_3$ content in the bath was maintained substantially constant by adding every 15 min an amount of $Al_2O_3$ adjusted according to the analysed composition of the bath 30.

During the first 24 hours the cell voltage was stable at 3.6 volts and the $Al_2O_3$ consumption corresponded to about 60% of the theoretical value.

After this initial period the cell voltage and the alumina consumption started to decrease. After 50 hours The cell voltage had gone down from 3.6 volt to 3.2 volt and the alumina consumption had dropped from about 60% to about 20% of the theoretical value. At the same time, the reduction of anodic oxygen escape was visually observed.

After 100 hours the anode 40 was removed from the bath 30 and examined. The corrosion of the anode 40 led to a reduction of about 2 mm of the average diameter of the anode 40. The anode cross-section showed a non-uniform and non-adherent external oxide scale on the metallic substrate.

The analysis of the composition of the bath 30 showed an increase of its $AlF_3$ content from 16% to about 30% which was caused by the cathodic reduction of Na ions.

The change of the cell voltage, the alumina consumption and the bath composition during electrolysis was caused by the preferential reduction of Na ions on the cathodically polarised carbon sidewalls 11 directly exposed to the bath 30, which led to the increase of the $AlF_3$ content in the bath 30 and the decrease of the $Al_2O_3$ consumption and of the cell voltage.

The cathodically produced metallic Na dissolved in the bath 30 reached a level at which the metallic Na reacted with the biatomic oxygen evolving on the anode 40 reducing the concentration of oxygen thereon and possibly thereafter metallic Na reacted directly with the integral oxide layer, which led to a deterioration of the oxide layer and the formation of non-adherent FeO at the anode surface and accelerated dissolution and corrosion of the anode 40 for the reasons described above.

EXAMPLE 2

Another of the above identical nickel-iron alloy anodes was used in a cell, as shown in FIG. 2, having cathodically non-polarised upper parts 17 of carbon sidewalls 15 exposed to the molten electrolyte 30, the cathodically polarised sidewall bottom parts 16 being shielded from the electrolyte by a sleeve of fused alumina 50.

The electrolysis was carried out under the same operating conditions as in Example 1.

Like in the previous Example, during the first 24 hours the cell voltage was stable at 3.6 volts and the $Al_2O_3$ consumption corresponded to about 60% of the theoretical value.

After this initial period the cell voltage remained substantially stable. However, the $Al_2O_3$ consumption decreased. After 50 hours the $Al_2O_3$ consumption had stabilised at 50% of the theoretical value.

After 100 hours the anode 40 was removed from the bath 30 and examined.

The external dimensions of the anode 40 had not significantly changed. The wear of the anode 40 led to a reduction of the average diameter of the metallic core by 0.4 mm from 20 to 19.6 mm. The anode 40 was covered with an oxide scale of about 200 microns thick. No severe anode corrosion was observed.

The analysis of the bath sample showed a slight increase of the $AlF_3$ content of less than 1%.

The absence of any significant cathodic formation of Na metal on the carbon surfaces explained the reduced wear rate of the anode compared to Example 1.

It is believed that the decrease of the alumina consumption is due to the presence of soluble $CO_2$ in the electrolyte. $CO_2$ can be produced from the unprotected upper part 17 of the sidewalls 15 directly in the form of $CO_2$ by chemical oxidation or in the form of CO, also by chemical oxidation, or carbon dust which may by chemically oxidised by the oxygen produced at the anode 40 to form $CO_2$. The soluble $CO_2$ can react with aluminium metal at the interface of the aluminium layer 20/bath 30 to form $Al_2O_3$ and CO. The re-oxidation of aluminium constitutes the main cause of the decrease of the $Al_2O_3$ consumption.

The oxidation of carbon dust or carbon monoxide by anodically evolved oxygen has only a small effect on the concentration of oxygen at the anode 40 which explains the low anode wear results (corrosion resistance) of Example 2 compared to Example 1.

EXAMPLE 3

The last anode of the above identical nickel-iron alloy anode was used in a cell, as shown in FIG. 3, in which no carbon is exposed to the electrolyte 30.

The electrolysis was carried out under the same operating conditions as in Examples 1 and 2.

The cell voltage was stable at 3.6 volts, and the $Al_2O_3$ consumption corresponded to about 60% of the theoretical value throughout the test.

After 100 hours the anode was removed for examination. The external dimensions of the anode were substantially unchanged.

The external dimensions of the anode 40 had not significantly changed. The wear of the anode 40 led to a reduction of the average diameter of the metallic core by 0.3 mm from 20 to 19.7 mm, which is even better than in Example 2. The anode was covered by a dense and coherent oxide scale of about 200 microns thick. No noticeable anode corrosion was observed.

The improvement of the anode wear rate between Examples 2 and 3 is believed to be due to the presence in Example 2's electrolyte of elemental carbon, such as carbon dust, or oxidisable carbon compounds, essentially carbon monoxide, from the unprotected upper parts 17 of carbon sidewalls 15. As discussed above, such a carbon source in the electrolyte constitutes an agent for chemically reducing the anode's oxide and especially evolved oxygen at the anode's surface, which impairs the quality of the anode's oxide layer.

Summary of the Examples

When cathodically polarised carbon material is exposed to molten electrolyte under the cell conditions of Example 1, a significant amounts of transition metal oxides of low level of oxidation, e.g. FeO, are produced at the anode's surface.

As mentioned above, the production of oxides of low level of oxidation is caused by the presence of metallic Na produced cathodically on the polarised carbon material and dissolved in the bath. The cathodically produced metallic Na reacts with the oxygen evolving on the anode. This reduces the concentration of oxygen on the anode's surface and thus the oxidation level of the metal oxides at the anode's surface.

As seen in Example 1, these oxides of low level of oxidation, such as ferric oxide (FeO), are non-uniform and non-adherent. Some corrosion was also observed.

It is unclear whether the corrosion of the anode observed in Example 1 was mainly due to internal electrolytic dissolution of the anode, which happens when pores or cracks in the integral oxide layer are so large that dipoles created thereacross under anodic polarisation reach the level of the potential of electrolytic dissolution of the oxides (typical in a large ferric oxide scale), in other words indirectly caused by the presence of sodium metal leading to this oxide structure, or whether this corrosion was mainly due to direct reaction of metallic Na with the integral oxide layer which happens when the oxygen level on the anode surface is not sufficient to shield the anode from metallic sodium.

It is likely that both mechanisms occurred simultaneously, but it is difficult to estimate their respective contribution to the observed anode corrosion. In either case, whether the corrosion is produced directly or indirectly as a result of the presence of metallic sodium in the electrolyte, the corrosion level observed at the anode is concomitant with the presence of metallic sodium in the molten electrolyte.

When all cathodically polarised carbon material is shielded from the electrolyte, as in Examples 2 and 3, a significant improvement of the quality of the anode oxide produced in-situ at the anode's surface is observed. The coherence of the anode's oxide and the wear rate of the anode lead to longer lifetime than an anode operated under the conditions of Example 1.

By comparing Examples 2 and 3, when all (cathodically polarised and unpolarised) carbon materials of the cell are shielded from the molten electrolyte, the anode wear rate is reduced, i.e. 0.3 mm instead of 0.4 mm wear after 100 hours. This improvement of the anode wear rate, although noticeable, is less than the improvement observed between cell operation with exposed cathodically polarised carbon material (Example 1) and cell operation without exposed cathodically polarised carbon material (Examples 2 and 3).

What is claimed is:

1. A method of inhibiting dissolution of an oxygen-evolving anode of a cell for the production of aluminium from alumina dissolved in a sodium ion-containing molten electrolyte comprising a cathodic material that is predominately active for the reduction of sodium ions rather than aluminium ions, the oxygen-evolving anode comprising a transition metal-containing alloy having an integral oxide layer containing predominantly one or more transition metal oxides which slowly dissolve in the electrolyte and are compensated by oxidation of the alloy at the alloy/oxide layer interface, said method comprising providing a sodium-inert layer on the sodium-active cathodic material and electrolysing the dissolved alumina whereby oxygen is anodically evolved and aluminium ions rather than sodium ions are cathodically reduced on the sodium-inert layer to inhibit the presence in the molten electrolyte of soluble cathodically-produced sodium metal that constitutes an agent for chemically reducing said transition metal oxides and evolved oxygen, the sodium-inert layer being used as a dissolution inhibitor of the anode by its effect in inhibiting reduction of said transition metal oxides by sodium metal and in maintaining the evolved oxygen at the anode at a concentration such as to produce at the alloy/oxide layer interface stable and coherent transition metal oxides having a high level of oxidation.

2. The method of claim 1, wherein the sodium-active cathodic material comprises carbon.

3. The method of claim 2, wherein the cathodic material is made of petroleum coke, metallurgical coke, anthracite, graphite, amorphous carbon, fullerene, low density carbon or a mixture thereof.

4. The method of claim 1, wherein the sodium-inert layer comprises molten aluminium.

5. The method of claim 1, wherein the sodium-inert layer comprises one or more borides.

6. The method of claim 5, wherein said borides are selected from borides of titanium, chromium, vanadium, zirconium, hafnium, niobium, tantalum, molybdenum, cerium, nickel and iron.

7. The method of claim 5, wherein the sodium-inert layer comprises a boride-containing coating on the sodium-inert cathodic material.

8. The method of claim 7, wherein the boride-containing coating comprises consolidated boride particles.

9. The method of claim 8, wherein the boride particles are consolidated in a dried inorganic polymeric and/or colloidal binder.

10. The method of claim 9, wherein the dried inorganic binder is selected from colloidal and/or inorganic polymeric oxides selected from alumina, silica, yttria, ceria, thoria, zirconia, magnesia, lithia, monoaluminium phosphate and cerium acetate and combinations thereof, all in the form of colloids and/or inorganic polymers.

11. The method of claim 1, wherein the sodium-inert layer comprises a conductive element or compound, in particular a metal such as Cu, Al, Fe or Ni for enhancing the electrical conductivity of the layer.

12. The method of claim 11, wherein the sodium-inert layer further comprises at least one aluminium-resistant refractory compound selected from borides, silicides, nitrides, carbides, phosphides, oxides and aluminides.

13. The method of claim 12, wherein the aluminium-resistant refractory compound is selected from alumina, silicon nitride, silicon carbide and boron nitride.

14. The method of claim 12, wherein the aluminium-resistant refractory compound is in the form of a reticulated structure.

15. The method of claim 1, wherein the sodium-inert layer comprises an aluminium-wetting agent selected from at least one metal oxide and/or at least one partly oxidised metal, said metal oxide and/or partly oxidised metal being reactable with molten aluminium when exposed thereto to form an alumina matrix containing metal of said particles and aluminium.

16. The method of claim 15, wherein said aluminium-wetting agent is selected from iron, copper, cobalt, nickel, zinc and manganese in the form of oxides and partly oxidised metals and combinations thereof.

17. The method of claim 1, wherein the alloy of the oxygen-evolving anode contains at least one transition metal selected from Ti, V, Cr, Mn, Fe, Co, Ni, Cu, Nb, Mo, Ru, Rh, Pd, Ir, Pt, Au, Ce and Yb and combinations thereof.

18. The method of claim 17, wherein the alloy of the oxygen-evolving anode contains at least one of iron, nickel and cobalt.

19. The method of claim 18, wherein the alloy of the oxygen-evolving anode is an iron alloy containing nickel and/or cobalt.

20. The method of claim 1, wherein the alloy of the oxygen-evolving anode contains at least one further metal selected from Li, Na, K, Ca, Y, La, Al, Zn, Ga, Zr, Ag, Cd and In.

21. The method of claim 1, wherein the alloy of the oxygen-evolving anode contains at least one constituent selected from elemental and compounds of H, B, C, O, F, Si, P, As, Se and Te.

22. The method of claim 1, wherein the electrolyte comprises sodium fluoride and aluminium fluoride, in particular cryolite.

23. The method of claim 22, wherein the electrolyte comprises at least one further fluoride selected from fluorides of calcium, lithium and magnesium.

24. The method of claim 1, wherein the electrolyte is at temperature in the range from 660° to 1000° C., in particular from 720° to 960° C., preferably from 850° to 940° C.

25. A method of electrowinning aluminium in a cell for the production of aluminium from alumina dissolved in an sodium ion-containing molten electrolyte, said cell comprising a sodium-active cathodic material and an oxygen-evolving anode that comprises a transition metal-containing alloy having an integral oxide layer containing predominantly one or more transition metal oxides which are slowly dissolved in the electrolyte and compensated by oxidation of the alloy at the alloy/oxide layer interface, said method comprising using a sodium-inert layer on the cathodic material to inhibit dissolution of the anode as defined in claim 1 and cathodically producing aluminium.

26. A method of inhibiting dissolution of an oxygen-evolving anode of a cell for the production of aluminium from alumina dissolved in an molten electrolyte comprising ions of at least one metal selected from sodium, lithium and potassium, which cell comprises a cathodic material that is predominately active for the reduction of such electrolyte metal ions rather than aluminium ions, the oxygen-evolving anode comprising a transition metal-containing alloy having an integral oxide layer containing predominantly one or more transition metal oxides which slowly dissolve in the electrolyte and are compensated by oxidation of the alloy at the alloy/oxide layer interface, said method comprising providing a layer that is inert to said electrolyte metal ions on said cathodic material and electrolysing the dissolved alumina whereby oxygen is anodically evolved and aluminium ions rather than said electrolyte metal ions are cathodically reduced on the inert layer to inhibit the presence in the molten electrolyte of soluble cathodically-reduced electrolyte metal ions that constitute agents for chemically reducing said transition metal oxides and evolved oxygen, the inert layer being used as a dissolution inhibitor of the anode by its effect in inhibiting reduction of said transition metal oxides by said cathodically-reduced electrolyte metal ions and in maintaining the evolved oxygen at the anode at a concentration such as to produce at the alloy/oxide layer interface stable and coherent transition metal oxides having a high level of oxidation.

27. A method of inhibiting dissolution of an oxygen-evolving anode of a cell for the production of aluminium from alumina dissolved in an molten electrolyte comprising carbon-based material that is reactable with oxygen, in particular molecular oxygen, and/or carbon dioxide, or that produces carbon dust, the oxygen-evolving anode comprising a transition metal-containing alloy having an integral oxide layer containing predominantly one or more transition metal oxides which slowly dissolve in the electrolyte and are compensated by oxidation of the alloy at the alloy/oxide layer interface, said method comprising providing an oxygen-stable layer on the carbon-based material and electrolysing the dissolved alumina whereby oxygen is anodically evolved and aluminium ions are cathodically reduced, the oxygen-stable layer inhibiting the presence in the molten electrolyte of said carbon dust or carbon monoxide that constitutes an agent for chemically reducing said transition metal oxides and evolved oxygen to form carbon dioxide, said oxygen-stable layer being used as a dissolution inhibitor of the anode by its effect in inhibiting reduction of said transition metal oxides by said carbon dust or carbon monoxide and in maintaining the evolved oxygen at the anode at a concentration such as to produce at the alloy/oxide layer interface stable and coherent transition metal oxides having a high level of oxidation.

28. The method of claim 27, wherein the oxygen-stable layer comprises nitrides and/or carbides, such as silicon nitride, silicon carbide and/or boron nitride.

29. The method of claim 27, wherein the oxygen-stable layer comprises fused alumina.

30. The method of claim 27, wherein the oxygen-stable layer comprises an aluminium-wetted coating.

31. The method of claim 27, wherein the cell comprises sidewalls made of carbon-based material that is reactable with oxygen.

* * * * *